US005272045A

United States Patent [19]

Patel et al.

[11] Patent Number: 5,272,045

[45] Date of Patent: Dec. 21, 1993

[54] WATER SOLUBLE ANTIFOGGANT FOR POWDER DEVELOPER SOLUTIONS

[75] Inventors: Dinesh P. Patel, Edison; John L. Adkins, Clark, both of N.J.

[73] Assignee: Sun Chemical Corporation, Fort Lee, N.J.

[21] Appl. No.: 976,123

[22] Filed: Nov. 13, 1992

[51] Int. Cl.[5] ..... G03C 5/18; G03C 5/26; G03C 5/16; G03C 1/06

[52] U.S. Cl. ..... 430/449; 430/349; 430/444; 430/446; 430/450; 430/465; 430/489; 430/493; 430/614; 430/963

[58] Field of Search ..... 430/350, 355, 403, 404, 430/444, 446, 450, 465, 489, 493, 614, 963, 349, 449

[56] References Cited

U.S. PATENT DOCUMENTS

| | | | |
|---|---|---|---|
| 2,271,229 | 1/1942 | Peterson et al. | 430/489 |
| 2,324,123 | 7/1943 | Weissberger | 430/489 |
| 2,384,593 | 9/1945 | Bean | 430/489 |
| 3,390,998 | 7/1968 | Cole | 430/493 |
| 3,622,330 | 11/1971 | Valiaveedan | 430/493 |
| 3,640,719 | 2/1972 | Von König et al. | 430/614 |
| 3,813,250 | 5/1974 | Yakamura et al. | 430/614 |
| 3,972,719 | 8/1976 | Vanreusel et al. | 430/446 |
| 4,001,021 | 1/1977 | Nakajima et al. | 430/446 |
| 4,255,510 | 3/1981 | Simons et al. | 430/446 |
| 4,284,709 | 8/1981 | Tomka | 430/493 |
| 4,323,642 | 4/1982 | Levinson | 430/489 |
| 4,378,425 | 3/1983 | Schnöring et al. | 430/449 |
| 4,379,836 | 4/1983 | Schnöring et al. | 430/449 |
| 4,756,990 | 7/1988 | Ooms et al. | 430/449 |
| 4,978,603 | 12/1990 | Inoue et al. | 430/446 |
| 5,141,843 | 8/1992 | Ooms | 430/489 |

FOREIGN PATENT DOCUMENTS

| | | | |
|---|---|---|---|
| 43-13497 | 6/1968 | Japan | 430/614 |

*Primary Examiner*—Charles L. Bowers, Jr.
*Assistant Examiner*—J. Pasterczyk
*Attorney, Agent, or Firm*—Jack Matalon

[57] ABSTRACT

Solid anti-fogging agents such as 5-nitroindazole which are otherwise poorly soluble in water are converted to readily water soluble compositions that are solids at room temperature when they are first dissolved in water soluble polymers or other organic compounds that have a melting point above room temperature and do not chemically react with the anti-fogging agent. The anti-foggants are preferably dissolved in the polymer or organic compound at or near the compounds' melting point below 175°C.

14 Claims, 1 Drawing Sheet

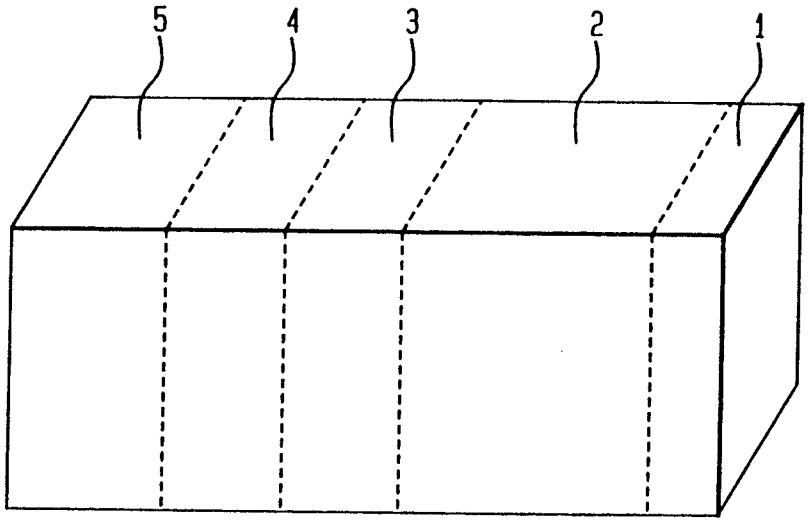
FIGURE

WATER SOLUBLE ANTIFOGGANT FOR POWDER DEVELOPER SOLUTIONS

This invention relates to a rapid access photographic developer. More particularly, the invention relates to a solid, rapid access, complete photographic developer composition containing high contrast producing anti-fogging agents combined in a single part, readily water soluble developer mixture.

BACKGROUND OF THE INVENTION

One of the more recent major advances in the art of photographic film development has been the formulation of a class of rapid access film developer systems for use with automated film processors. With a modification in developer formulation, it is known that it is possible to develop films in about 60–90 seconds by using a developer temperature of over 100° F. (38° C). When this capability is combined with the capability of automated film processors to substantially facilitate and shorten film development process steps, a major improvement in the art is realized, one which has been well received by customers and thereby established as a fixed part of the industry landscape. Reformulated, rapid access developers reduce overall film development time to a few minutes from film development process times previously measured in hourly parts.

When the process is artfully carried out, rapid access automated film development rewards the operator with great convenience, reproducibility, less labor, and lower unit cost. The required hands-on skills shift more to routine machine operations and away from those of the skilled artisan. Consequently, tasks such as preparation of critical rapid access developer solutions are configured to be as easy and error-proof to execute as possible. To that end, the industry today uses premeasured single part or double part developer packages containing all of the principal developer, auxiliary developer, additives, sulfite and alkali in the correct proportions required to prepare a developer aqueous solution of a given volume simply by mixing the entire contents of the package with the appropriate amount of water. The two part developer package is distinguished over the single part package primarily by the inclusion of a restrainer or anti-fogging agent in a second package, essentially as a non-aqueous solution. The developer package can be provided as a single or double part depending on whether or not anti-fogging agent is included in the formulation.

With all its advantages, rapid access film processing is troubled by low contrast development in the film. Film processing at elevated temperature to accelerate development is burdened by a tendency to produce some film fogging that reduces contrast and compromises the ability to distinguish half tones in the film. However, the problem can be readily ameliorated and high contrast capability restored by including an anti-fogging agent in the developer formulation. This is the purpose of the two part system as known in the art where the second part contains the requisite anti-fogging agent that provides high contrast capability to the rapid access film development process.

The formulation of rapid access developer into premeasured, solid, single part packages has been accomplished to provide operational reliability and convenience to the industry and to lessen some of the environmental problems associated with liquid waste container disposal when the single part or two part developer is packaged and sold as a concentrated solution. However, the formulation of single part, rapid access solid developer that includes anti-fogging agent is faced with some challenging problems, as described hereinafter. Consequently, rapid access developer that includes anti-fogging compounds are sold as two part, solid/liquid systems where the anti-fogging agent is provided in solution in a separate or second package containing non-aqueous solvent.

Anti-fogging agents are well known in the art. They are typically organic compounds selected from the group of nitrogen heterocyclic compounds; 5-nitroindazole and benzimidazole are representative of the general class. Rapid access developer formulations containing 5-nitroindazole are formulated as two part systems, dictated by the general instability of the compound in alkaline medium with loss of anti-fogging activity and the poor solubility of the compound in water. If solid nitroindazole is incorporated as part of a solid, single part rapid access developer formulation in the prior art, the indazole does not dissolve when added to the make-up water. Typically, it floats to the top of the tank, rendering the working developer solution unusable.

One approach taken by artisans in the field to overcome the problem of the poor solubility of nitroindazole in water and thus allow the formulation of a solid, single part rapid access developer is to substitute novel anti-fogging agents for nitroindazole in the formulation. U.S. Pat. No. 5,141,843 to Ooms, et al. discloses a new class of anti-fogging agents based on derivatives of tetrazole that are stable and water soluble. It is taught that these new anti-fogging agents can be formulated into a single part developer that obviates the need to include nitroindazole in the formulation. As effective as these new agents, or other new agents, may be, it would be desirable to provide a solid, rapid access, single part developer system that includes established and effective anti-fogging agents, particularly nitroindazole. 5-nitroindazole, for instance, is well known and accepted in the art as an anti-fogging agent so that finding a means to successfully include it in a single part, solid, rapid access developer system would represent an acceptable and highly useful contribution to the art.

It is an objective of this invention to provide a solid, high contrast, rapid access developer comprising a readily water soluble, single part composition.

Another objective of the invention is to provide the above readily water soluble, solid, single part, high contrast, rapid access developer composition containing nitroindazole, particularly 5-nitroindazole, as the anti-fogging agent.

Yet a further objective of the present invention is to provide a method for producing the foregoing novel solid, single part, rapid access developer.

A specific goal of the invention is to provide a composition comprising solid, readily water soluble anti-fogging agents or mixtures, particularly solid, readily water soluble 5-nitroindazole compositions, and a method for producing these water soluble compositions.

SUMMARY OF THE INVENTION

Solid anti-fogging agents which are otherwise poorly soluble in water are converted to readily water soluble compositions that are solids at room temperature when they are first dissolved in water soluble polymers or other organic compounds that have a melting point above room temperature and do not chemically react with the anti-fogging agent. The solid compositions so formed to contain the anti-fogging agent are combined in predetermined amounts with other solid components of rapid access developers in a solid, single part package. The package, when added to the appropriate amount of water, dissolves quickly and completely to yield a clear working solution of rapid access film developer with the capability of producing high contrast in developed film. Accordingly, the instant invention comprises: solid, high contrast, rapid access film developer compositions; solid, water soluble anti-fogging compositions; and methods for preparing these compositions.

Anti-fogging agents useful in the invention include, but are not limited to, nitroindazole and nitrobenzimidazole. The polymers and other organic compounds useful in the invention include all those water soluble materials having a melting point above room temperature (24° C.) and specifically including alcohols, amines, aminoalcohols, polyglycols and polyols.

More specifically, the invention comprises a water soluble solid anti-fogging additive mixture for photographic film developer for promoting high film contrast. The mixture comprises at least one anti-foggant or anti-fogging agent selected from the group consisting of nitroindazole and nitrobenzimidazole, each having at least one nitro substituent group; and at least one water soluble solid organic compound having a melting point between 24° C. and 175° C. and selected from the group consisting of alcohols, amines, aminoalcohols, polyglycols and polyols.

The novel anti-foggant compositions of the instant invention are prepared by a process comprising dissolving an anti-foggant selected from the group consisting of 5-nitroindazole, 6-nitroindazole, 6-nitrobenzimidazole, and mixtures thereof, in an organic solvent at about the melting point of the solvent between about 24° C. and 175° C. whereby a solution of said anti-foggant in said solvent is formed; and cooling the solution to form a solid mixture containing the anti-foggant.

DESCRIPTION OF THE DRAWING

The FIGURE is a schematic representation of the single part high contrast rapid access developer package or "brick" of the instant invention.

DETAILED DESCRIPTION OF THE INVENTION

Referring to the FIGURE, a preferred package of the product of the instant invention is illustrated. This package, characteristically called a "brick" in the art since it is in the shape of a brick, contains all the chemical components in powder form and in the correct amount needed to prepare a given quantity of working solution of rapid access developer when dissolved in water. In actual practice, the vacuum packed brick is unwrapped from its protective cover and deposited into a previously measured quantity of water wherein it dissolves. The brick is unique in the manner in which the chemicals are incorporated into the form. The brick is divided into vertical layers from end to end such that the more acid and alkaline components occupy the extreme or end layer positions while the intermediate layers are occupied by more weakly acid or weakly alkaline components. This arrangement protects the acidic main developer, usually hydroquinone, from the strong alkali components of the brick. Any solid geometric form can be used as the brick, i.e., cylindrical, triangular, etc. It is important, however, to keep the acidic and alkaline components physically separated in the single package and, of course, to include the anti-foggant composition prepared according to the process of the invention.

As the FIGURE illustrates by example for the instant invention, the first layer (1) comprises the principal developer hydroquinone. The second layer (2) is a mixture that includes the auxiliary developer Dimezone S (Charkit Chemical), benzotriazole, 2-mercaptobenzothiazole, thiosalicylic acid, polyethyleneglycol, sodium erythorbate, potassium bromide, EDTA, sodium metabisulfite and an anti-fogging agent, preferably 5-nitroindazole prepared according to the invention as described hereinafter. The third layer (3) is potassium metabisulfite. The fourth layer (4) is sodium hydroxide and the fifth layer (5) is potassium carbonate.

For the present invention, the anti-fogging agent of the invention may be present in a mixture any combination of components of the solid developer formulation other than strong alkali. For instance, in the foregoing example the anti-foggant of the invention may be included with the primary developer in the first layer. Preferably, however, the anti-foggant is included in a subsequent layer or segregated part. The operative principle in the present invention is segregation of mutually reactive solid components, i.e., separation of solid components from other solid components of the rapid access developer with which they can react prior to use. Other than forming layers in a "brick" format, the components of the mixture can be segregated in water soluble capsules or bags. Specifically, single or multiple components of the rapid access developer can be encapsulated using solid, water soluble polymers such as polyvinylalcohol/polyvinylacetate or polyvinylpyrrolidone. When added to water, the polymer "shell" dissolves and a working solution of rapid access developer is formed.

As those skilled in the art will appreciate, other developer chemicals or additives may be included in the above formulation without deviating from the spirit or scope of the invention.

Hydroquinone and substituted hydroquinones known in the art are preferred principal developers in the instant invention. Substituted hydroquinones include: chlorohydroquinone, bromohydroquinone, isopropylhydroquinone, toluhydroquinone, methylhydroquinone, 2,3-dichlorohydroquinone, 2,5-dimethylhydroquinone, 2,3-dibromohydroquinone, 1,4-dihydroxy-2-acetophenone-2,5-dimethylhydroquinone, 2,5-diethylhydroquinone, 2,5-di-p-phenylethylhydroquinone, 2,5-dibenzoylaminohydroquinone, or 2,5-diacetaminohydroquinone, or mixtures thereof.

Various auxiliary developing agents can be used in the instant invention including, but not limited to, p-aminophenol, p-methylaminophenol and p-phenylene diamine sulfate.

Sulfite, particularly meta or hydrogen bisulfite, can be present as the ammonium or alkali metal bisulfite.

To prepare a single part rapid access developer that has high contrast capability the selection of the type of anti-fogging agent incorporated in the developer formulation and the method used for preparing the anti-fogging agent are of fundamental importance. As previously noted, commonly used and preferred anti-foggants are typically solid organic compounds with poor solubility in water. It is through the selection of the anti-fogging agent and the method of its preparation that the problems relating to the dissolution of the antifogging agent in the aqueous developer solution are overcome in the present invention.

Anti-foggants useful in the invention include any nitroindazole, particularly 5-nitroindazole (5-ND) or 6-nitroindazole (6-ND). Also included is any nitrobenzimidazole, particularly 6-nitrobenzimidazole (6-NBD).

It has been discovered that there are several classes of organic materials, i.e., low molecular weight crystalline compounds and polymeric amorphous or crystalline solids, that are solvents for the foregoing anti-foggants, soluble in water and have melting or softening points within a useful range above room temperature and below the decomposition temperature of the anti-foggant. It has further been discovered that when the anti-foggants are dissolved in these materials and cooled to room temperature, solid mixtures thought to be solid solutions are produced comprising anti-foggant and solvent. These solutions or mixtures are soluble in water. When they are included in the formulation of a solid rapid access developer, a developer is produced having high contrast capability which is completely soluble in water. The anti-foggant incorporated as part of the solid solution or mixture remains in solution and does not precipitate when the brick in which it has been included is added to water to prepare the developer working solution.

The mixture of anti-foggant and organic solvent referred to herein is described as a solid solution. This is intended as a non-binding theoretical conclusion of the probable physical chemistry of the mixture. However, whether a true solid solution or a mixture, the anti-foggant/solvent combination is functionally defined as a room temperature solid, water soluble mixture having anti-fogging capability when mixed with solid rapid access developer known in the art.

The attributes of the organic material used to dissolve the anti-foggant include a crystalline melting point or softening temperature above 24° C. to provide a liquid solvent. The melting or softening range should be between 24° C. and 175° C. since temperature above 175° C. can result in some undesirable decomposition of the anti-foggant. The solvent should be essentially unreactive toward the anti-foggant at least to the extent that it does not alter the anti-fogging functionality of the chemical and compatible with other components of the rapid access developer mixture. Solvating properties of the solvent toward the anti-foggant should be high in order to form concentrated solid solutions, although solid solutions in the range of 0.1 weight percent anti-foggant to 66 weight percent anti-foggant are acceptable.

The preferred method of preparing the solid solution of anti-foggant and solvent of the instant invention is to melt the solid solvent and mix the anti-foggant with warm or hot liquid solvent until the anti-foggant is dissolved. The solution is cooled to near room temperature or until solidification occurs. The anti-foggant and solvent can also be premixed as solids and heated, if necessary up to 175° C., to prepare a solution which is cooled or allowed to cool to solidify.

Optionally, the solid solution of the invention may be prepared by dissolving both the anti-foggant and the solid solvent in a common solvent and removing the common solvent by means known in the art such as evaporative distillation. The method would comprise a process for the production of a water soluble solid anti-fogging additive mixture for high contrast photographic film developer, comprising dissolving an anti-foggant selected from the group consisting of 5-nitroindazole, 6-nitro indazole, 6-nitrobenzimidazole, and mixtures thereof, and an organic solvent having a melting point above 24° C. in an organic solvent having a melting point below 24° C. whereby a solution of the anti-foggant in the solvent having a melting point below 24° C. is formed; evaporating the solvent having a melting point below 24° C. and recovering a solid mixture comprising the anti-foggant and the organic solvent having a melting point above 24° C. However, whether prepared by melt mixing or by using a common solvent, the anti-foggant solid solutions of the invention may be prepared containing one or a mixture of anti-foggants.

Solvents having a melting point above 24° C. useful in the invention to prepare the solid solutions or mixtures include:

water soluble polymers such as polyvinyl pyrrolidone and polyoxyalkylenes such as polyalkylene glycols having a weight average molecular weight greater than 800; the glycols, preferably polyethylene glycol (PEG) and polypropylene glycol, are semi-solid to solid at room temperature;

amines and aminoalcohols that are solid at room temperature with melting points greater than 24° C. including 3-piperidino-1,2-propanediol, 2-amino-2-methyl-1,3-propanediol and 1-piperidino-2,3-dihydroxypropane.

alcohols and polyols that are solid at room temperature with melting points greater than 24° C. including 2,2-dimethyl-1,3-propanediol (DMPD) and 2-ethyl-2-hydroxymethyl-1,3-propanediol.

Solid solutions prepared from these solvents contain between 1 weight percent and 50 weight percent of said anti-foggant. The mixture weight ratio of said organic compound to said anti-foggant is between 1:1 and 100:1.

The following examples illustrate the present invention in the preparation of the novel solid solutions of anti-foggant and their formulation into solid, high contrast rapid access developer. The products of the invention are compared with prior art rapid access developer formulations to illustrate the advantages of the invention in the production of high contrast film.

EXAMPLE 1

Preparation of 5-ND Solid Solution with PEG 1450

3.5 gms of Polyethylene glycol (PEG 1450 M.W.) and 0.2 gms of 5-nitroindazole (5-ND) are mixed and the mixture heated until it melts to produce a clear yellow solution. The hot solution is allowed to cool and solidify. The solid is ground into a powder and used in the formulation of rapid access developer.

EXAMPLE 2

Preparation of High Contrast Rapid Access Developer Brick

A solid, layered brick comprising five separate vertical sequential layers of powder is prepared in a mold. The first layer consists of 17.5 gms of hydroquinone. The second layer consists of a mixture comprising 3.7 gms of the anti-foggant solid solution of Example 1; 0.15 gms of Dimezone-S; 0.9 gms thiosalicylic acid; 3 gms of sodium erythorbate; 3 gms of potassium bromide; 2 gms of ethylenediaminetetraacetic acid (EDTA); and 4 gms of sodium metabisulfite The third layer consists of 3 gms of potassium metabisulfite. The fourth layer consists of 4 gms of sodium hydroxide. The fifth layer consists of 5 gms of potassium carbonate. The brick is prepared such that layers 1 and 5 are at opposite ends to prevent the hydroquinone layer from reacting with the highly alkaline layers 4 and 5. For storage and shipment the brick is preferably vacuum packed.

The contents of the brick are dissolved in one liter of water with manual stirring to prepare a working rapid access developer solution having high contrast capability in which the 5-ND remains in solution.

A series of comparison experiments was carried out to illustrate the high contrast capability of the rapid access developer prepared employing the novel anti-fogging compositions and methods of the invention. Working developer was prepared from rapid access developer bricks following the general method described in Example 2. The solid solutions of anti-fogging agent and solvent (Examples E, F, H, K and N) were prepared by the hot melt method of Example 1 and compared to developer prepared with anti-foggant not predissolved in solid solvent (Examples C, D, G, J and M) or containing no anti-foggant (Examples A, B, I and L). The formulations of Examples A - N are presented in Table 1.

TABLE 1

| MATERIALS. g/l | A | B | C | D | E | F | G | H |
|---|---|---|---|---|---|---|---|---|
| Hydroquinone[1] | 17.5 | 17.5 | 17.5 | 17.5 | 17.5 | 17.5 | 17.5 | 17.5 |
| Dimezone-S[2] | 0.15 | 0.15 | 0.15 | 0.15 | 0.15 | 0.15 | 0.15 | 0.15 |
| Benzotriazole[2] | 0.02 | 0.02 | 0.02 | 0.02 | 0.02 | 0.02 | 0.02 | 0.02 |
| 2-mercaptobenzothiazole[2] | 0.025 | 0.025 | 0.025 | 0.025 | 0.025 | 0.025 | 0.025 | 0.025 |
| Thiosalicylic acid[2] | 0.075 | 0.075 | 0.075 | 0.075 | 0.075 | 0.075 | 0.075 | 0.075 |
| Polyethylene Glycol (PEG)[2] | — | 2.838 | — | 2.838 | — | — | 2.838 | — |
| 3-piperidino-1,2propanol diol (PPD)[2] | — | — | — | — | — | — | — | — |
| 2,2-dimethyl-1,3-propanediol (DMPD)[2] | — | — | — | — | — | — | — | — |
| 5-nitroindazole (5ND)[2] | — | — | 0.162 | 0.162 | — | — | — | — |
| 6-nitroindazole (6ND)[2] | — | — | — | — | — | — | — | — |
| 6-nitrobenzimidazole (6NBD)[2] | — | — | — | — | — | — | 0.081 | — |
| PEG1450 (2.83 g) + 5ND (0.162 g)[2] | — | — | — | — | 3 | — | — | — |
| PPD (2.83 g) + 5ND (0.162 g)[2] | — | — | — | — | — | — | — | — |
| DMPD (12 g) + 5ND (0.162 g)[2] | — | — | — | — | — | — | — | — |
| PEG1450 (2.83 g) + 6ND (0.162 g)[2] | — | — | — | — | — | 3 | — | — |
| PEG1450 (2.83 g) + 6NBD (0.081 g)[2] | — | — | — | — | — | — | — | 2.919 |
| Sodium Erythobate[2] | 3 | 3 | 3 | 3 | 3 | 3 | 3 | 3 |
| Potassium Bromide[2] | 3 | 3 | 3 | 3 | 3 | 3 | 3 | 3 |
| EDTA Acid[2] | 2 | 2 | 2 | 2 | 2 | 2 | 2 | 2 |
| Sodium Metabisulfite[2] | 4 | 4 | 4 | 4 | 4 | 4 | 4 | 4 |
| Potassium Metabisulfite[3] | 36 | 36 | 36 | 36 | 36 | 36 | 36 | 36 |
| Sodium Hydroxide[4] Beads | 23 | 23 | 23 | 23 | 23 | 23 | 23 | 23 |
| Potassium carbonate[5] | 20 | 20 | 20 | 20 | 20 | 20 | 20 | 20 |
| Water | 966 | 966 | 966 | 966 | 966 | 966 | 966 | 966 |
| Ph | 10.92 | 10.92 | 10.92 | 10.92 | 10.92 | 10.92 | 10.92 | 10.92 |
| Color | none | none | 1 yel | 1 yel | 1 yel | 1 brn | 1 yel | 1 yel |
| Nature | clear | clear | NDppt | NDppt | clear | clear | clear | clear |

| MATERIALS. g/l | I | J | K | L | M | N |
|---|---|---|---|---|---|---|
| Hydroquinone[1] | 17.5 | 17.5 | 17.5 | 17.5 | 17.5 | 17.5 |
| Dimezone-S[2] | 0.15 | 0.15 | 0.15 | 0.15 | 0.15 | 0.15 |
| Benzotriazole[2] | 0.02 | 0.02 | 0.02 | 0.02 | 0.02 | 0.02 |
| 2-mercaptobenzothiazole[2] | 0.025 | 0.025 | 0.025 | 0.025 | 0.025 | 0.025 |
| Thiosalicylic acid[2] | 0.075 | 0.075 | 0.075 | 0.075 | 0.075 | 0.075 |
| Polyethylene Glycol (PEG)[2] | — | — | — | — | — | — |
| 3-piperidino-1,2propanol diol (PPD)[2] | 2.838 | 2.828 | — | — | — | — |
| 2,2-dimethyl-1,3-propanediol (DMPD)[2] | — | — | — | 12 | 12 | — |
| 5-nitroindazole (5ND)[2] | — | 0.162 | — | — | 0.162 | — |
| 6-nitroindazole (6ND)[2] | — | — | — | — | — | — |
| 6-nitrobenzimidazole (6NBD)[2] | — | — | — | — | — | — |
| PEG1450 (2.83 g) + 5ND (0.162 g)[2] | — | — | — | — | — | — |
| PPD (2.83 g) + 5ND (0.162 g)[2] | — | — | 3 | — | — | — |
| DMPD (12 g) + 5ND (0.162 g)[2] | — | — | — | — | — | 12.16 |
| PEG1450 (2.83 g) + 6ND (0.162 g)[2] | — | — | — | — | — | — |
| PEG1450 (2.83 g) + 6NBD (0.081 g)[2] | — | — | — | — | — | -Y- |
| Sodium Erythobate[2] | 3 | 3 | 3 | 3 | 3 | 3 |
| Potassium Bromide[2] | 3 | 3 | 3 | 3 | 3 | 3 |
| EDTA Acid[2] | 2 | 2 | 2 | 2 | 2 | 2 |
| Sodium Metabisulfite[2] | 4 | 4 | 4 | 4 | 4 | 4 |
| Potassium Metabisulfite[3] | 36 | 36 | 36 | 36 | 36 | 36 |
| Sodium Hydroxide[4] Beads | 23 | 23 | 23 | 23 | 23 | 23 |
| Potassium carbonate[5] | 20 | 20 | 20 | 20 | 20 | 20 |
| Water | 966 | 966 | 966 | 966 | 966 | 966 |
| Ph | 10.92 | 10.92 | 10.92 | 10.92 | 10.92 | 10.92 |
| Color | none | 1 yel | 1 yel | none | 1 yel | 1 yel |
| Nature | clear | NDppt | clear | clear | NDppt | clear |

[1] = first layer;
[2] = second layer;
[3] = third layer;
[4] = fourth layer.
[5] = fifth layer Table 1 shows that Examples E, F, K, M and N incorporating the anti-foggant composition of the invention prepared by an initial melt mixing of anti-foggant with an anti-foggant solvent which is solid at or near room temperature results in the preparation of a solid, rapid access developer that produces a clear solution when dissolved in water. When 5ND is included in the developer formulation alone or without melt mixing in a solvent, the 5ND precipitates from the developer solution (Examples C, D, J and M). Significantly, 5ND precipitates from these developer solutions even when the solid developer formulation contains the solid anti-foggant solvent which has not been melt mixed with 5ND (Examples D, J and M).

The fact that 5ND anti-foggant, when included in a solid rapid access developer formulation in the same layer containing a solid solvent for 5ND (Examples, D, J and M), precipitates from the developer solution is instructive as to the novelty of the anti-foggant composition of the invention. Acting in situ in the developer solution, the 5ND solvent clearly does not solubilize 5ND. The soluble anti-foggant composition is the product of the process of pre-melt mixing the 5ND and solid solvent. However, the resulting composition retains the anti-foggant utility of 5ND and is water soluble. This distinguishes the composition over 5ND and the solid solvent. While it is not known with certainty whether the composition is entirely a solid solution with 5ND as solute, a mixture of solids, a new chemical species or some combination of all, the foregoing examples establish the distinction of the substance produced by the pre-melt mix process over 5ND alone or in combination with a simple solid/solid mixture of 5ND and solid solvent.

Employing test procedures well known to those skilled in the art, contrast gradients were measured in an Automatic Density Reader on exposed film developed at 30 second development time at 100° F. (38° C.) using rapid access developers described in Examples A–N. The test procedure is described in Photographic Sensitometry by Hollis N. Todd, published by John Wiley & Sons, Inc., incorporated herein in its entirety by reference with respect to such test procedures and their interpretation. The results are presented in Table 2:

TABLE 2

| | SPEED | | | GRADIENT | | | BASE/FOG | |
|---|---|---|---|---|---|---|---|---|
| EXP | S1 | S2 | S3 | G1 | G2 | G3 | B/F | COLOR |
| A | 310 | 120 | 158 | 2.65 | 8.5 | 8.4 | 0.07 | none |
| B | 340 | 320 | 168 | 2.75 | 8 | 6.9 | 0.07 | none |
| C | 270 | 116 | 152 | 2.62 | 10 | 8.3 | 0.04 | 1.yel |
| D | 292 | 128 | 168 | 2.88 | 10.5 | 8.3 | 0.04 | 1.yel |
| E | 278 | 124 | 166 | 2.97 | 11.4 | 7.8 | 0.04 | 1.yel |
| F | 275 | 132 | 164 | 2.85 | 11.2 | 9.9 | 0.04 | 1.br |
| G | 264 | 88 | 123 | 2.56 | 7.6 | 6.7 | 0.03 | 1.yel |
| H | 274 | 102 | 139 | 2.85 | 8.4 | 7.3 | 0.04 | 1.yel |
| I | 322 | 118 | 162 | 2.74 | 8.3 | 7.3 | 0.07 | none |
| J | 280 | 120 | 158 | 2.9 | 10.1 | 8.1 | 0.04 | 1.yel |
| K | 320 | 142 | 195 | 2.78 | 11.2 | 7.6 | 0.04 | 1.yel |
| L | 314 | 115 | 157 | 2.57 | 8.29 | 7.3 | 0.06 | none |
| M | 281 | 112 | 152 | 2.84 | 9.3 | 7.5 | 0.05 | 1.yel |
| N | 304 | 130 | 174 | 2.68 | 10.3 | 7.8 | 0.04 | 1.yel |

In Table 2, speed is expressed arithmetically as the anti-logarithm of 3 minus the relative log exposure at an optical density of 0.5, 4.0 and 3.0, respectively for speeds S1, S2 and S3, above base plus fog. Gradient is defined by the following equation for G2 as an example:

G2=change in density/ log S3/S1 or;

G2=3.0−0.5/ log 158/310=8.5.

The examples that contain the composition of the present invention, Examples E, F, H, K and N, all formed clear solutions and provided high contrast gradients (G2). This gradient is taken between 0.5 and 3.0 density. These high contrast examples were prepared with a preheated mixture of anti-foggants 5ND, 6ND, or 6NBD with PEG1450, 3ppD, or DMPD. In all other examples, the high contrast agents were not applied with heat and, therefore, did not completely dissolve when the powder developer was added to water. Undissolved material is unacceptable for use. Such undissolved material also causes gradients to be lower and fog higher.

The single part rapid access developers of the instant invention demonstrate high gradients unmatched by single part developers known in the art and are more characteristic of two part developers. However, they avoid the prepackaged solutions of two part systems, the inconvenience and the environmental problems associated with the use and manufacture of concentrated solutions.

While the invention has been disclosed by reference to specific examples, there is no intent to limit the instant invention except as described in the following claims.

What is claimed is:

1. A water soluble solid solution antifogging additive for photographic film powder developer for promoting high film contrast, said additive comprising the product of a process comprising:

dissolving an antifoggant selected form the group consisting of 5-nitroindazole, 6-nitroindazole and 6-nitrobenzimidazole, and mixtures thereof, in an organic solvent at about the melting point of said solvent between about 24° C. and 175° C. whereby a solution of said antifoggant in said solvent is formed; and cooling said solution to form said solid solution antifogging additive.

2. The additive of claim 1 further comprising converting said solid solution additive to a powder after said cooling.

3. The additive of claim 1 wherein said solvent is selected form the group consisting of alcohols, amines, aminoalcohols, polyglycols and polyols.

4. The additive of claim 1 wherein said solvent comprises polyethylene glycol and/or polypropylene glycol having a weight average molecular weight of at least 800.

5. The additive of claim 1 wherein said solid solution additive contains between 1 weight percent and 50 weight percent of said antifoggant.

6. A water soluble solid solution anti-fogging additive for photographic film developer for promoting high film contrast, said additive comprising a solid solution comprising:

at least one anti-foggant selected from the group consisting of nitroindazole and nitrobenzimidazole, each having at least one nitro substituent group; and at least one water soluble solid organic compound having a melting point between 24° C. and 175° C. and selected from the group consisting of alcohols, amines, aminoalcohols, polyglycols and polyols.

7. The additive of claim 6 wherein said anti-foggant comprises 5-nitroindazole.

8. The mixture of claim 1 wherein said anti-foggant comprises 6-nitroindazole.

9. The mixture of claim 1 wherein said anti-foggant comprises 6-nitrobenzimidazole.

10. The mixture of claim 1 wherein said polyglycols comprise polyethylene glycol.

11. The mixture of claim 1 wherein said polyglycols comprise polypropylene glycol.

12. The mixture of claim 1 wherein said aminoalcohols include 3-piperidino-1,2-propanol, 2-amino-2-methyl-1,3-propanediol and 1-piperidino-2,3-dihydroxypropane.

13. The mixture of claim 1 wherein said polyols are selected from the group consisting of 2,2-dimethyl-1,3-propanediol, 2-ethyl-2-hydroxymethyl-1,3-propanediol and pentaerythritol.

14. The mixture of claim 1 wherein the weight ratio of said organic compound to said anti-foggant is between 1:1 and 100:1.

* * * * *